US005754213A

United States Patent [19]

Whritenor

[11] Patent Number: 5,754,213

[45] Date of Patent: May 19, 1998

[54] DOCUMENT PRODUCTION APPARATUS AND METHOD HAVING A NONCONTACT SENSOR FOR DETERMINING MEDIA PRESENCE AND TYPE

[75] Inventor: James Andrew Whritenor, Mendon, N.Y.

[73] Assignee: Eastman Kodak Company, Rochester, N.Y.

[21] Appl. No.: 108,488

[22] Filed: Aug. 18, 1993

Related U.S. Application Data

[63] Continuation-in-part of Ser. No. 896,037, Jun. 9, 1992, abandoned.

[51] Int. Cl.[6] ..... B41J 13/03

[52] U.S. Cl. ..... 347/218; 250/559.4

[58] Field of Search ..... 250/561, 559.4; 346/134, 136; 347/218

[56] References Cited

U.S. PATENT DOCUMENTS

| | | | |
|---|---|---|---|
| 4,586,834 | 5/1986 | Hachisuga et al. | 400/120 |
| 4,617,580 | 10/1986 | Miyakawa | 346/136 |
| 4,639,152 | 1/1987 | Yamamoto et al. | 400/120 |
| 4,661,824 | 4/1987 | Kuge | 346/76 PH |
| 4,667,208 | 5/1987 | Shikari et al. | 346/76 PH |
| 4,771,296 | 9/1988 | Shimada | 346/76 PH |
| 4,784,714 | 11/1988 | Shibata | 156/354 |
| 4,795,999 | 1/1989 | Takahashi et al. | 346/76 PH |
| 4,835,603 | 5/1989 | Kano et al. | 346/76 PH |
| 4,881,831 | 11/1989 | Takita et al. | 400/617 |
| 4,887,168 | 12/1989 | Endo et al. | 346/76 PH |
| 4,890,120 | 12/1989 | Sasaki et al. | 346/76 PH |
| 4,897,670 | 1/1990 | Hasegawa et al. | 346/76 PH |
| 4,923,847 | 5/1990 | Ito et al. | 503/227 |
| 4,983,854 | 1/1991 | Mizuno et al. | 250/561 |
| 4,999,649 | 3/1991 | Saji et al. | 347/218 |
| 5,084,627 | 1/1992 | Ueki et al. | 250/561 |
| 5,087,925 | 2/1992 | No et al. | 346/76 PH |

FOREIGN PATENT DOCUMENTS

| | | | |
|---|---|---|---|
| 0266209 | 5/1988 | European Pat. Off. | 400/708 |
| A-0-496 300 | 7/1992 | European Pat. Off. | B41J 29/44 |
| 0216769 | 9/1988 | Japan | 400/708 |

OTHER PUBLICATIONS

*Patent Abstracts of Japan*, vol. 11, No. 131 (M-584) (2578) 24 Apr. 1987; & JP-A-61 272 178 (N. Ozawa) 2 Dec. 1986.

*Patent Abstracts of Japan*, vol. 13, No. 318 (M-852) (3666) 19 Jul. 1989; & JP-A-01 103 473 (Y. Kobayashi) 20 Apr. 1989.

*Primary Examiner*—Huan H. Tran

*Attorney, Agent, or Firm*—Milton S. Sales

[57] ABSTRACT

An apparatus for detecting the presence and type of receiver media in a document production apparatus, such as a copier, thermal printer or other printing device, includes a noncontact sensor and media transport means. Media transport means transports as least two different types of receiver media along a transport path. The noncontact sensor is positioned along a sensor plane and has a light emitting member that emits light along the sensor plane towards the media, and a light detecting member that collects light reflected from the media along the sensor plane and produces a signal that is related to the amount of light collected. The presence of the signal indicates that media is present and the amount of reflected light is indicative of the type of media.

10 Claims, 5 Drawing Sheets

DOCUMENT PRODUCTION APPARATUS AND METHOD HAVING A NONCONTACT SENSOR FOR DETERMINING MEDIA PRESENCE AND TYPE

CROSS REFERENCE TO RELATED APPLICATIONS

This application is a continuation-in-part of U.S. application Ser. No. 07/896,037 filed on Jun. 9, 1992 now abandoned, entitled THERMAL PRINTER HAVING A NONCONTACT SENSOR OR DETERMINING MEDIA TYPE by James A. Whritenor.

TECHNICAL FIELD

This invention relates generally to document production apparatus such as copiers or printers, and, more particularly, to a sensor for determining the presence and type of media.

BACKGROUND OF THE INVENTION

A sensor is useful in a document production apparatus such as copiers and printers, such as a thermal printer or other printing device, to detect the presence of receiving media. Sensors can also determine the type of media present. To reliably sense the presence and type of media, the sensor must be precisely positioned. Sensing the position of thermal receiver media in a thermal printer is not a trivial task.

Some media sensing methods and apparatus require mechanical structure such as arms or levers that are moved by the media as the media follows the transport path to actuate microswitches or proximity switches. These types of mechanical sensing devices are susceptible to wear which can cause inaccurate sensing. Also, worn parts can cause scratching of the media, media jams, and a failure to transport the media when the worn part protrudes into the media transport path. Mechanical sensing devices are, in addition, difficult to position accurately because of microswitch actuation point tolerances and the requirements for light mechanism loads necessary to avoid most scratches.

Mechanisms that use proximity switches require more parts than other mechanisms to translate the motion from the sensing arm or lever to the microswitch. The additional parts cause proximity sensor designs to be expensive to manufacture. Accordingly, it will be appreciated that it would be highly desirable to have a sensor with few mechanical parts which is simple to manufacture.

There are noncontact sensors that do not require as many parts as mechanical sensors and proximity devices. U.S. Pat. No. 4,639,152, which issued Jan. 27, 1987 to Yamamoto et al., discloses a thermal printer that includes a reflection-type sensor located between front and rear rollers to detect the smoothness of the printing surface. U.S. Pat. No. 4,890,120, which issued Dec. 26, 1989 to Sasaki et al., discloses a thermal transfer-type printer that includes an optical sensor which detects discrimination codes on the ink sheet. U.S. Pat. No. 4,887,168, which issued Dec. 12, 1989 to Endo et al., discloses optical sensors used to detect the movement of a document. Edamura (JP 63-216769) discloses a recording paper with an identification mark indicative of the type of the paper; a detector detects the mark by projecting light from a light emitting element and receiving light reflected from the recording paper.

Some noncontact sensors have been operated in the media transport path and found to be inadequate because of the unpredictable results obtained. Transparent media is especially difficult to sense because of the nondispersing nature and low reflectivity of the media surface. Because of these problems, sensor mechanisms have typically used mechanical designs.

SUMMARY OF THE INVENTION

The present invention is directed to overcoming one or more of the problems set forth above. According to one aspect of the present invention, an apparatus for detecting the presence and type of receiver media in a document production apparatus includes a noncontact sensor and media transport means. The noncontact sensor is positioned along a sensor plane and has a light emitting member that emits light along the sensor plane towards the media, and a light detecting member that detects light reflected from the media along the sensor plane. The media transport means transports the media along a path which intersects the sensor plane, allowing for the detection of presence and media type.

The noncontact sensor detects media presence and type, eliminates scratches and jams, reduces manufacturing costs by lowering the number of parts required, and provides simpler hardware designs. Further, the media type information can be used to optimize the printing process for that particular media type. The repeatability and predictability of the detection zone is defined by the sensor only, rather than many mechanical parts, thereby increasing detection accuracy.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
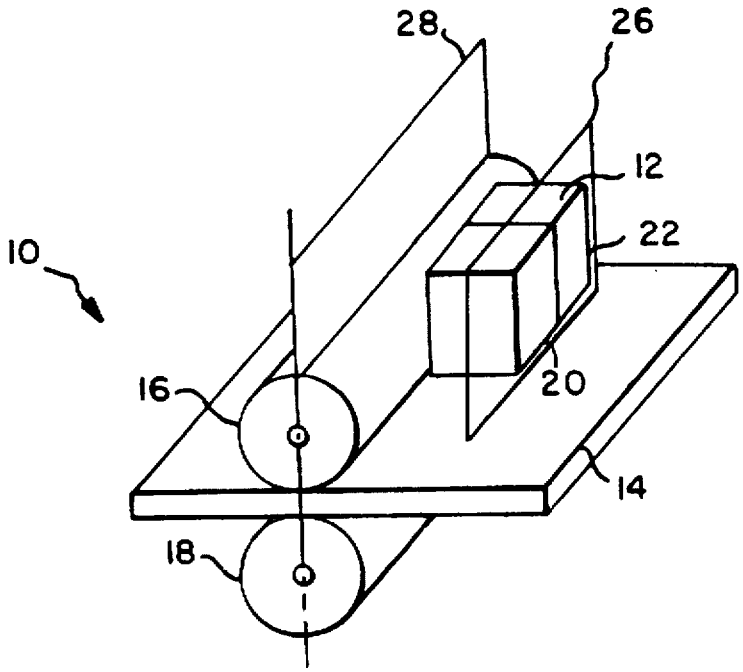
FIG. 1 is a diagrammatical perspective view of a document production apparatus media transport system incorporating a noncontact sensor.

Referring to FIG. 1, a thermal printer 10 (one example of a document production apparatus) includes a noncontact sensor 12 for detecting the presence of dye receiver media 14 and for determining the type of media present. The media 14 may be opaque, such as is used for photographic-like thermal prints, or the media 14 may be transparent. A media transport mechanism includes rollers 16, 18 which constrain the media 14 to a plane. As illustrated, rollers 16, 18 are positioned one on each side of the media 14 to functionally maintain the media 14 in a flat plane in the vicinity of the rollers 16, 18.

Figure 2:
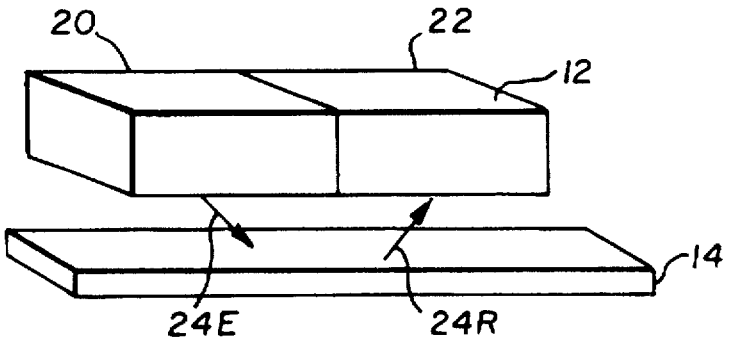
FIG. 2 is a diagrammatic side view of the sensor of FIG. 1.

Referring to FIG. 2, the noncontact sensor 12 preferably includes a light emitting member 20 and a light detecting member 22. These members may be combined as a single unit or they may be independent components. Electromagnetic radiation, such as emitted light 24E, leaves light emitting member 20 (i.e., a light source) traveling in the direction of media 14. When media 14 is present, some portion of emitted light 24E is reflected or scattered towards light detecting member 22. The reflected light 24R collected by light detecting member 22 produces a signal that is related to the amount of light collected. The presence of this signal indicates that media 14 is present in the media transport path. The amount of reflected light 24R is related to the type of media 14 present; that is, opaque, reflective media will reflect a different amount of light than transparent media, thereby causing different signal levels to be generated for opaque and transparent medias. The differences in these signals indicates which type of media 14 is present.

Both light emitting member 20 and light detecting member 22 are oriented such that their optical surfaces face in a downward direction to avoid collecting dust. Dust collection, over time, would reduce the performance of the sensor and result in reduced reliability of the component.

Again referring to FIG. 1, a sensor plane 26 contains emitted light 24E from light emitting member 20, and contains reflected light 24R from media 14 to light detecting member 22. This sensor plane 26 containing emitted light 24E and reflected light 24R is the plane of the noncontact sensor 12. FIG. 1 depicts the spatial relationship of media 14, noncontact sensor 12, and media transport rollers 16, 18. The axial centerlines of rollers 16, 18 define the roller plane 28.

Figure 3:
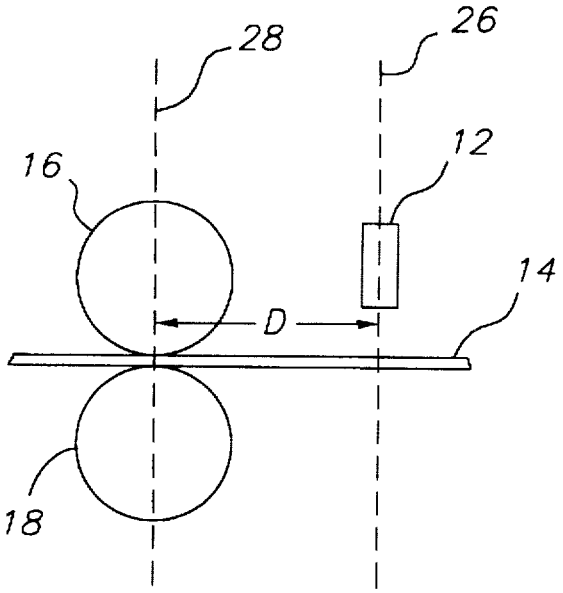
FIG. 3 is a front view of a media transport system, illustrating an orientation of the media relative to the sensor plane wherein the media follows a planar path when exiting the transport rollers.

As shown in FIG. 3, sensor plane 26 is located a distance D from roller plane 28. Distance D being the perpendicular distance to the optical surface of sensor 12 at sensor plane 26 from roller plane 28.

Figure 4:
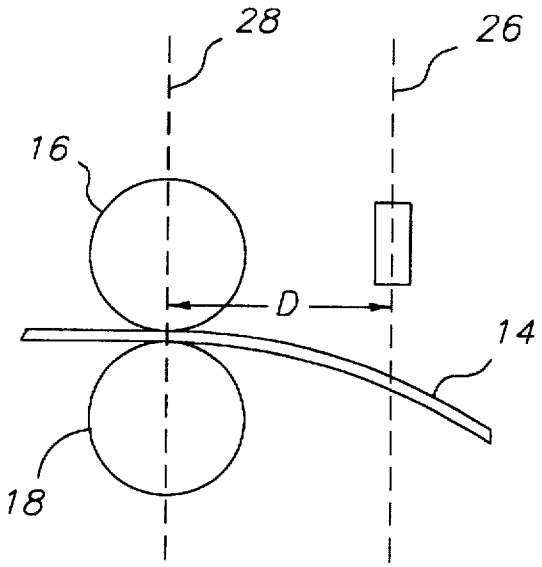
FIG. 4 is a front view of a media transport system, illustrating an orientation of the media relative to the sensor plane wherein the media follows a non-planar path when exiting the transport rollers.

Referring to FIG. 3, media 14 is, preferably, perpendicular to sensor plane 26. This positioning maximizes the amount of reflected light 24R collected by light detecting member 22. Such a positioning would occur, for example, when media 14 is supported on either side of sensor plane 26 to be constrained in a plane. In the present invention, media 14 is supported on the one side by transport rollers 16, 18 and free of support on the other side. Therefore, because of gravity, variations in media 14, and the printing environment (for example, environmental humidity), media 14 generally will not pass through rollers 16, 18 in a planar path which is perpendicular to sensor plane 26. More typically, media 14 will exit rollers 16, 18 and curve in a downward, non-planar path, as shown in FIG. 4. Furthermore, if more than one type of media is used, this curved path may be more exaggerated for one media type than another, depending on the characteristics of the media. In the preferred embodiment of the present invention, two types of media are used, an opaque media, referenced as Kodak Thermal Paper 831-4510 and a transparent media, referenced as Kodak Transparency 845-8838. Since these two media have different physical characteristics, each follows a different curved path when exiting rollers 16, 18.

Positioning sensor 12 as close as possible to roller plane 28 will promote the preferred perpendicular orientation between media 14 and sensor plane 26. However, because of physical constraints, sensor 12 must be positioned at least a distance D equal to the minimum radius R of rollers 16, 18 away from rollers 16, 18. If distance D is sufficiently small, media 14 may intersect sensor plane 26 in a perpendicular orientation.

Figure 5:
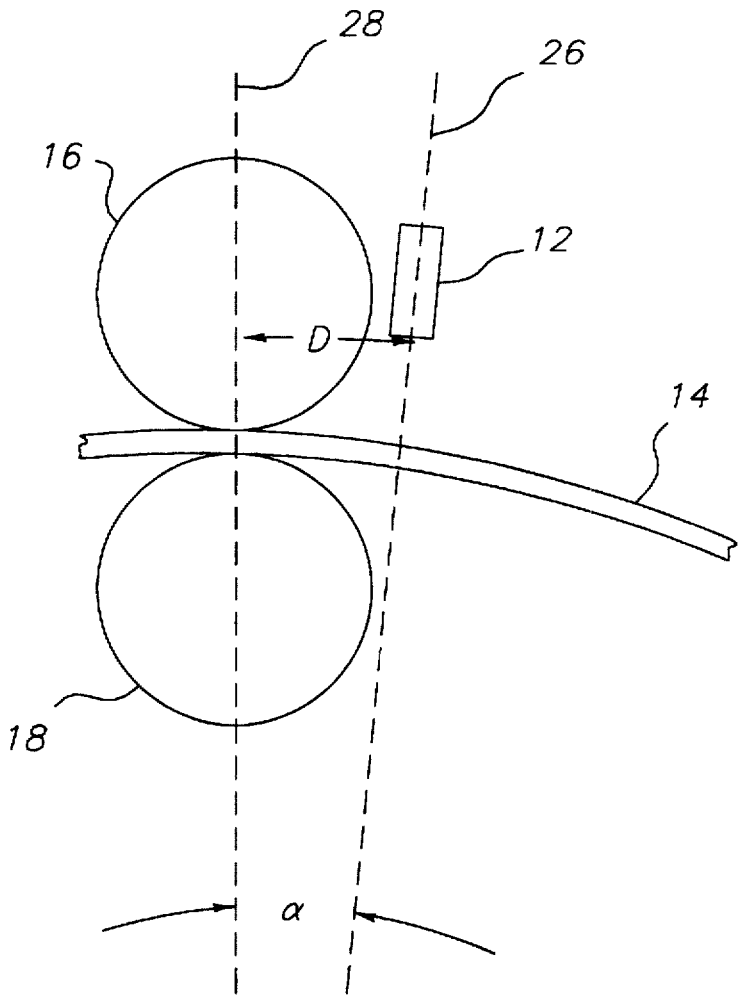
FIG. 5 is a front view of a media transport system, illustrating the angular orientation of the noncontact sensor relative to the roller plane.

However, if distance D is not sufficiently small, media 14 will not intersect sensor plane 26 in a perpendicular orientation. To compensate for this non-perpendicularity, sensor plane 26 is oriented at an angle $\alpha$ relative to roller plane 28. This angular orientation is shown in FIG. 5. When more than one type of media is used, the angular orientation, $\alpha$, of sensor plane 26 is selected to compensate for the curvature and reflectivity of the various types of media.

Figure 6:
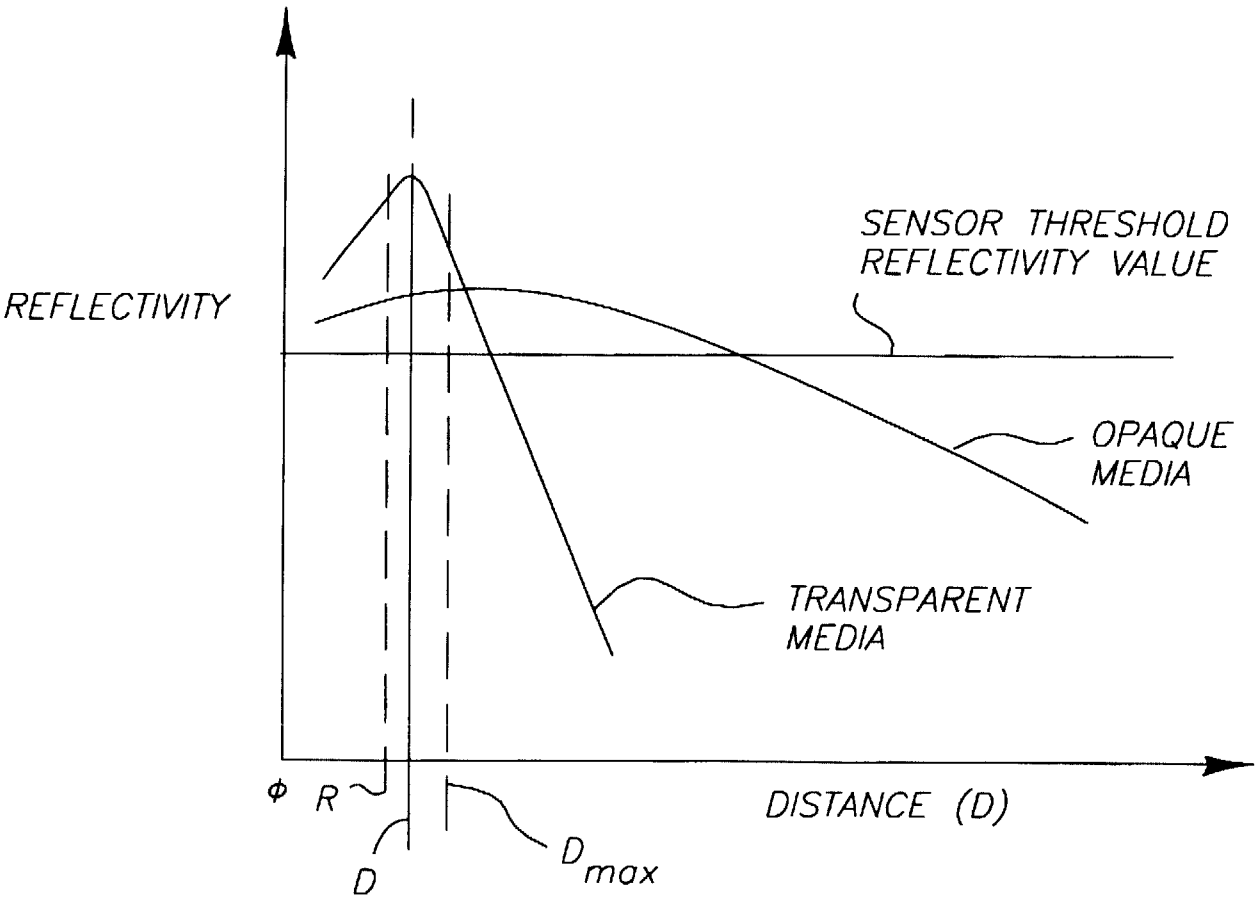
FIG. 6 is a graph of Reflectivity versus Distance for each media type at a particular angular orientation of the sensor plane.

It is preferable to position sensor 12 as close to transport rollers 16, 18 as possible and then select a value for angle $\alpha$ which yields the signal response sufficient to discriminate between the two media types. FIG. 6 shows a plot of Reflectivity versus Distance from roller plane 28 for each media type with sensor 12 positioned at a particular value of $\alpha$; that is, the amount of light received by the light detecting member at a distance. In addition, a threshold reflectivity value is plotted; this value is the minimum design reflectivity value to account for tolerances from, for example, the sensor, gain electronics, and mounting. For the particular value of $\alpha$ plotted in FIG. 6, the value of D at which sensor 12 is positioned provides for a signal response which discriminates between the two media types; the signals are above the threshold reflectivity value and the difference in the signals is able to be distinguished by sensor 12. A value of $D_{max}$, as shown in FIG. 6, is the maximum acceptable distance D in which to position sensor 12. This value of $D_{max}$ is determined by selecting a distance value less than the intersection points of the threshold reflectivity value plot with the media plots where the reflectivity value of the media types allows differentiation.

As shown in FIG. 6, an acceptable distance D in which sensor 12 can be positioned from roller plane 28 can vary between R, the radius of rollers 16, 18, and $D_{max}$. Preferably, sensor 12 is positioned at a distance R but physical mounting means for sensor 12 may cause sensor 12 to be positioned at a distance closer to distance $D_{max}$.

In an embodiment of the present invention, the value of $\alpha$ ranges between approximately 5 and 9 degrees, with the preferred embodiment having a value of approximately 7 degrees.

In this preferred embodiment, the radius R of rollers 16, 18 are 0.79 inches and 0.75 inches and sensor 12 is positioned a distance D of 0.480 inches.

Note that changing the value of $\alpha$ will shift the media plots of FIG. 6, resulting in different values of $D_{max}$. Further, varying the media types will also cause the media plots to shift, resulting in different values of $D_{max}$. From these comments it is noted that numerous variables exist in the determination of $D_{max}$.

It is conceivable to split rollers 16, 18 into segments to allow the positioning of sensor 12 close to roller plane 28. However, variations in the roller segments, such as from molding or machining, can raise concerns regarding misalignment, skewing, and scratching. Further, the segmenting of the rollers can be an additional manufacturing operation which increases cost.

Another variation would be to reduce the radius R of rollers 16, 18 in selected areas to allow the positioning of sensor 12 close to roller plane 28. Again, variations in rollers 16, 18 from molding or machining, may cause problems and increase manufacturing costs.

The detection of media 14 by sensor 12 serves as a reference signal for the placement of the printed thermal image on media 14. Therefore, preferably, sensor 12 is positioned along the length of rollers 16, 18 so as to be positioned at the middle portion of media 14. It is conceivable to position sensor 12 at the end of rollers 16, 18 rather than in the middle, thus allowing sensor 12 to be positioned close to roller plane 28. However, positioning sensor 12 at the end of rollers 16, 18 may cause noticeable misalignment of the printed thermal image on media 14. This is because, if the media 14 is skewed as it enters rollers 16, 18, sensor 12 will detect a corner of media 14, causing the thermal image to be aligned relative to that corner. In the preferred embodiment, sensor 12 detects the middle of the media 14, causing the thermal image to be aligned relative to the center of media 14.

Figure 7:
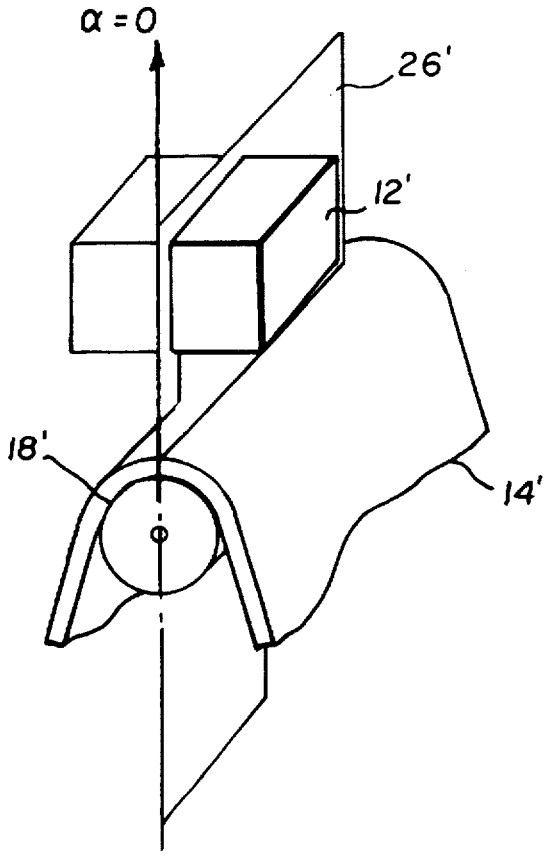
FIG. 7 is a perspective view similar to FIG. 1, but illustrating another preferred embodiment with a single roller.

Referring to FIG. 7, another embodiment of the invention is illustrated wherein the media 14' follows a curved path rather than a plane path. The media 14' wraps around a portion of the media transport roller 18' following a controlled arc or curved path. The plane 26' of the roller centerline and the planes 28' of the noncontact sensor 12' are coincident at the media surface, and the angle $\alpha$ is zero.

Operation of the present invention is believed to be apparent from the foregoing description, but a few words will be added for emphasis. When the media is absent the signal from the sensor has a low level. On the other hand, when the media is present, the signal has a higher level. The signal level for reflective media will be different than for transparent media, with both signal levels being higher than when no media is present. Thus, the lowest signal level indicates the absence of media, the intermediate signal level indicates the presence of one media type media, and the higher level is indicative of the presence of the other media type. In the present invention, of the two media types, the opaque media generally has a lower reflectivity value than the transparent media due to the opaque material's surface roughness, though the transparent media is intolerant of angle variations.

Noncontact sensing detects media presence and type, eliminates scratches and jams, reduces manufacturing costs by lowering the number of parts required, and provides simpler hardware designs than mechanical sensors permit. The sensor, located near the centerline of media support rollers and close to an edge of the media as the media is transported through the thermal printer, facilitates determination of the media presence and its type. A roller is included in the media transport mechanism to adequately maintain the angle of the media surface to the noncontact sensor. This solves the problem of unpredictable results obtained with prior sensors. For noncontact sensor mechanisms to be useful, they must account for the critical angle of the media relative to the sensor, the media surface's dispersing nature and reflectivity, reflected signal strength, and ambient light which causes noise that reduces the signal to noise ratio at the sensor. The present invention sensor electronics provides reliable, repeatable detection results by signal amplification to achieve signal to noise ratios that are insensitive to stray light. The repeatability and predictability of the detection zone is defined by the sensor only, rather than many mechanical parts, thereby increasing detection accuracy.

While the invention has been described with particular reference to the preferred embodiments, it will be understood by those skilled in the art that various changes may be made and equivalents may be substituted for elements of the preferred embodiment without departing from invention. For example, while the invention has been described with reference to a transport mechanism including transport rollers, media guides and other methods that ensure the media follows a predictable path may also be used. In addition, many modifications may be made to adapt a particular situation and material to a teaching of the invention without departing from the essential teachings of the present invention It can now be appreciated that there has been presented a noncontact sensor that operates with normal receiver media without requiring detection marks or other means of conveying information. The sensor is insensitive to media transport loads.

As is evident from the foregoing description, certain aspects of the invention are not limited to the particular details of the examples illustrated, and it is therefore contemplated that other modifications and applications will occur to those skilled the art. For example, while the invention has been described with reference to a thermal printer, the invention can be used effectively in an electrophotographic printer or other printing or copying apparatus. Also, the invention can be used with paper and other media as well as the thermal media described above. It is accordingly intended that the claims shall cover all such modifications and applications as do not depart from the true spirit and scope of the invention.

What is claimed is:

1. An apparatus for use in a document production apparatus for determining the presence and type of a receiver media by the inherent optical characteristics of the receiver media, said apparatus comprising:

a transport system adapted to selectively transport at least two different types of receiver media along a transport path, said transport system including first and second transport rollers (1) having parallel axes, (2) being adapted to receive the receiver media therebetween, and (3) defining a roller plane containing said parallel axes; and a sensor (1) being spaced from said transport path, (2) defining a sensor plane intersecting said transport path, said sensor plane intersecting said roller plane along a line substantially parallel to said parallel axes, wherein said transport path between said first and second transport rollers and said sensor plane is non-planar, (3) having a light source for emitting light along said sensor plane toward said transport path such that an amount of light is reflected from the receiver media in said transport path and the amount of light reflected from the receiver media in said transport path is a function of inherent optical characteristics of the receiver media, and (4) having a light detecting member for detecting light reflected from the receiver media when the receiver media enters the intersection of said sensor plane and said transport path, said light detecting member providing a signal with a value characteristic of the amount of light reflected by the receiver media to provide an indication of both the presence of said receiver media and the type of the receiver media.

2. The apparatus as defined by claim 1 wherein the at least two different types of receiver media include an opaque media and a transparent media.

3. The apparatus as defined by claim 2 wherein the amount of light detected by said light detecting member from the opaque media is less than the amount of light detected by said detecting member from the transparent media.

4. The apparatus as defined by claim 1 wherein:

said sensor plane intersecting said roller plane along a line substantially parallel to said parallel axes at an angle α, and said angle α is between approximately 5 and 9 degrees.

5. The apparatus as defined by claim 1 wherein:

said sensor includes an optical surface; and a perpendicular distance to the optical surface of said sensor from said roller plane is a distance D with a value greater than a minimum radius value of said first and second transport rollers.

6. The apparatus as defined by claim 1 wherein said sensor is positioned laterally approximately midway of the transport path.

7. The apparatus as defined by claim 1 wherein:

said apparatus has a threshold reflectivity value;

said first and second transport rollers have radii, r and R, respectfully; and said sensor includes an optical surface at said sensor plane positioned a perpendicular distance D from said roller plane such that (a) the value of D is greater than the lesser of radii r and R, (b) the amount of light received by said light detecting member at said distance D for each media type is greater than the threshold reflectivity value, and (c) the amount of light received by said light detecting member at said distance D is differentiable by said sensor to distinguish each media type.

8. An apparatus for use in a document production apparatus for determining the presence and type of a receiver media by the inherent optical characteristics of the receiver media, said apparatus comprising:

a transport system adapted to selectively transport at least two different types of receiver media along a transport path and including first and second transport rollers (1) having parallel axes, (2) being adapted to receive the receiver media therebetween, and (3) defining a roller plane containing said parallel axes; and a sensor (1) being spaced from said transport path, (2) defining a sensor plane intersecting said transport path and being at an angle α relative to said roller plane so as to intercept said roller plane along a line substantially parallel to said parallel axes, (3) having a light source for emitting light along said sensor plane toward said transport path such that an amount of light reflected from the receiver media in said transport path is a function of inherent optical characteristics of the receiver media, and (4) having a light detecting member for detecting light reflected from the receiver media when the receiver media enters the intersection of said sensor plane and said transport path, said light detecting member providing a signal with a value characteristic of the amount of light reflected by the receiver media to provide an indication of both the presence of said receiver media and the type of receiver media:

wherein:

said apparatus has a threshold reflectivity value;

said first and second transport rollers have radii, r and R, respectively; and said sensor includes an optical surface at said sensor plane positioned a perpendicular distance D from said roller plane such that (a) the value of D is greater than the lesser of radii r and R, (b) the amount of light received by said light detecting member at said distance D for each media type is greater than the threshold reflectivity value, and (c) the amount of light received by said light detecting member at said distance D is differentiable by said sensor to distinguish each media type.

9. A method for positioning a sensor for determining the presence and type of at least two types of receiver media in a document production apparatus of the type having (1) first and second media transport rollers having parallel axes and defining a roller plane, and (2) a sensor (i) defining a sensor plane at an angle α relative to said roller plane so as to intersect said roller plane along a line substantially parallel to said parallel roller axes, (ii) having a light detecting member for detecting light reflected from receiver media, and (iii) having an optical surface positioned a perpendicular distance D from said roller plane, said method for determining distance D comprising the steps of:

(1) orienting said sensor at angle α;

(2) identifying the radii r and R of said first and second transport rollers, respectively;

(3) identifying a threshold reflectivity value for said document production apparatus;

(4) identifying values of distance D wherein (i) the value of distance D is greater than the lesser of radii r and R, (ii) the amount of light received by said light detecting member at said distance D for each media type is greater than the threshold reflectivity value, and (iii) the amount of light received by said light detecting member at said distance D is differentiable by said sensor to distinguish each media type; and (5) selecting a value for distance D from said values identified in step (4).

10. A method for positioning a sensor for determining the presence and type of at least two types of receiver media in a document production apparatus of the type having (1) first and second media transport rollers having parallel axes and defining a roller plane, and (2) a sensor (i) defining a sensor plane at an angle α relative to said roller plane so as to intersect said roller plane along a line substantially parallel to said parallel roller axes, (ii) having a light detecting member for detecting light reflected from receiver media, and (iii) having an optical surface positioned a perpendicular distance D from said roller plane, said method for determining angle α comprising the steps of:

(1) positioning said sensor at distance D close to said first and second transport rollers;

(2) identifying a threshold reflectivity value for said document production apparatus;

(3) varying angle α to identify an orientation wherein (i) the amount of light received by said light detecting member for each media type is greater than the threshold reflectivity value, and (ii) the amount of light received by said light detecting member is differentiable by said sensor to distinguish each media type; and (4) selecting a value for angle α from the orientations identified in step (3).

* * * * *